United States Patent [19]

Endo et al.

[11] Patent Number: 4,898,545

[45] Date of Patent: Feb. 6, 1990

[54] THIN-TYPE COAXIAL CONNECTOR AND RECEPTACLE FOR MATING WITH THE COAXIAL CONNECTORS

[75] Inventors: Hiroshi Endo; Takao Suzuki; Mitsuo Komoto; Kouzou Uekido; Tetsuro Tokaichi, all of Tokyo, Japan

[73] Assignees: Japan Aviation Electronics Industry, Limited; NEC Corporation, both of Japan

[21] Appl. No.: 240,943

[22] Filed: Sep. 6, 1988

[30] Foreign Application Priority Data

Sep. 9, 1987 [JP] Japan ..... 62-138727[U]
Oct. 9, 1987 [JP] Japan ..... 62-154828[U]
May 20, 1988 [JP] Japan ..... 63-65895[U]

[51] Int. Cl.[4] ..... H01R 17/18
[52] U.S. Cl. ..... 439/578; 439/752
[58] Field of Search ..... 439/578–585, 439/675, 607–610, 877, 879, 752

[56] References Cited

U.S. PATENT DOCUMENTS

| | | | |
|---|---|---|---|
| 3,539,976 | 11/1970 | Reynolds | 439/585 |
| 3,923,367 | 12/1975 | Carter | 439/585 |
| 4,076,369 | 2/1978 | Ostapovitch | 439/852 |
| 4,445,745 | 5/1984 | Cartesse | 439/585 |
| 4,509,816 | 4/1985 | Freitag | 439/585 |
| 4,611,867 | 9/1986 | Ichimura et al. | 439/608 |
| 4,624,525 | 11/1986 | Ichimura et al. | 439/585 |

*Primary Examiner*—David Pirlot
*Attorney, Agent, or Firm*—Laff, Whitesel, Conte & Saret

[57] ABSTRACT

A thin-type coaxial connector and a coaxial multicore receptacle used together with the thin-type coaxial connectors are disclosed herein. The thin-type coaxial connector comprises a female central contact mechanically and electrically connected to a central conductor of coaxial cable by press-deforming, an insulator holder of a discrete sleeve fitted onto the central contact and an insulator sheath layer of the coaxial cable, a ferrule fitted onto an outer surface of the coaxial cable and covered with an outer conductor of the coaxial cable folded thereon, and an outer conductor sleeve closely fitted onto the insulator body and said folded outer conductor to clamp the outer conductor by the outer conductor sleeve and the ferrule. The receptacle comprises a substrate having a plurality of ground pins and power source pins set at cross points of a matrix pattern thereon and a plurality of signal pins, a guide plates overlaid on the substrate having guide holes for the ground pins, the power source pins, and the signal pins. The guide plate further comprises insulator caps covering the power source pins. A plurality of pairs of ground contacts are disposed over the guide plate for making contacts with the ground pins and outer conductor sleeves of coaxial connectors mating with the signal pins, and for clamping insulator caps, respectively.

5 Claims, 15 Drawing Sheets

THIN-TYPE COAXIAL CONNECTOR AND RECEPTACLE FOR MATING WITH THE COAXIAL CONNECTORS

BACKGROUND OF THE INVENTION (1) Field of the Invention

The present invention relates to a coaxial connector for use in mechanical connection of a coaxial cable and, in particular, to a coaxial connector of a thin type which has a diameter slightly larger than the coaxial cable. The present invention also relates to a coaxial multicore receptacle having pin contacts each mating with such a thin-type coaxial connector.

(2) Description of the Prior Art

In transmission of electrical signals, a coaxial cable is used which comprises a central conductor insulated from an outer conductor by an inner insulator, and an outer insulator jacket. A coaxial connector is used to connect the coaxial cable to an electric device.

Among known coaxial connectors, a small one of a thin type is used together with a coaxial multicore receptacle having a plurality of pin contacts for mating with such thin-type coaxial connectors.

JP-U-62-66187 (Jikkaisho 62-66187) discloses such a thin-type coaxial connector which comprises a central contact, for example, female contact to be connected with the central conductor of the coaxial cable by soldering, an insulator holder of two half-cylinders for holding the central contact together with the inner insulator of the coaxial cable, a ferrule to be mounted on the outer jacket of the coaxial cable, and an outer conductor sleeve fitted onto the insulator holder and the ferrule. The ferrule and the outer sleeve tightly clamp the outer conductor of the coaxial cable therebetween.

In the coaxial connector, the central conductor and the central contact are connected by soldering and the holder is constituted by a combination of two half-cylinder parts. This resultantly makes the assembling operation complex and confusing. Further, since the half-cylinder parts are low in resistance to deformation caused on handling, they have a problem of a high occurrence rate of inferior ones.

Moreover, the soldering process for connecting the central conductor and the central contact requires a high skilfulness for performing the process.

In the known thin-type coaxial connector, the female contact has spring contact portions which are formed at an axial end of the central contact. Therefore, the spring contact portions easily touch any external objects and thereby are easily deformed upon handling the central contact before and during assembling the coaxial connector. Further, a central axis of the contact spring portions should be coincident with a central axis of an opening for receiving the pin contact so that the pin contact reliably mates with the spring contact portions. These make assembling operation of the coaxial connector complex and difficult.

The coaxial multicore receptacle is used for connecting an electric circuit device such as a print circuit board or a large-scaled integrated circuit element to a plurality of coaxial cables through the thin-type coaxial connectors. A known coaxial multicore receptacle is disclosed in U.S. Pat. No. 4,611,867 which comprises a plurality of ground pins set upright on an insulating substrate and arranged in a matrix pattern, a plurality of signal pins set upright on the substrate each being located at the center of each box of the matrix pattern, first metallic lattice boards provided perpendicularly to the substrate each being positioned correspondingly to and above each column of the ground pins, and second metallic lattice boards provided perpendicularly to the substrate each being positioned correspondingly to and above each row of the ground pins. The first and second lattice boards cross one another orthogonally to define angular coaxial connector insertion holes surrounded by the boards and arranged in the matrix pattern. Each of the first lattice boards is formed with notches in the end portion on the side of the substrate to provide ground elements which are in elastic contact with the corresponding ground pins. As a coaxial connector is inserted into one of the coaxial connector insertion holes, a central contact of the coaxial connector comes into contact with the corresponding signal pin. Each of the first lattice boards is also formed with coaxial ground plates which come in elastic contact with outer conductor sleeves of adjacent coaxial connectors. Thus, signals pins are shielded by the coaxial ground plates.

In one application of the coaxial multicore receptacle, several power source pins are used in place of the ground pins on the substrate. In that case, several ones of the ground elements must be cut away at positions corresponding to the power source pins and insulating caps must be used to cover the power source pins. This tends to introduce an error in cutting ground elements and failure in covering the power source pins with insulator caps, in particular, when the ground pins and power source pins are arranged complex.

Further, the known coaxial multicore receptacle uses the second lattice boards in addition to first lattice boards and is therefore complicated in the structure.

SUMMARY OF THE INVENTION

Therefore, it is an object of the present invention to provide a thin-type coaxial connector wherein soldering is not used for connection of a central contact and a central conductor of a coaxial cable and which is, therefore, easy in assembling on an end of the coaxial cable with a reduced number of parts.

It is another object of the invention to provide a thin-type coaxial connector which has a female contact reliably receiving a pin contact even if the pin contact is inserted with a slight angle about the central axis of the contact.

It is still another object of the present invention to provide a coaxial multicore receptacle for use together with the thin-type coaxial connector which includes a plurality of power source pins in addition of ground pins and signal pins and is simple in structure.

A thin-type coaxial connector is used in electrical and mechanical connection of an end of a coaxial cable which comprises a central conductor insulated from an outer conductor by an inner insulator, and an outer insulator jacket. The outer jacket and the inner insulator are cut away at the cable end to expose the central conductor, the inner insulator and the outer conductor as an exposed central conductor, an exposed inner insulator, and an exposed outer conductor, respectively. The coaxial connector comprises a central contact to be electrically and mechanically connected to the exposed central conductor, an insulator holder for holding the central contact together with the exposed inner insulator, a ferrule to be mounted on the outer jacket, and an outer conductor sleeve fitted onto the insulator holder and the ferrule, the ferrule and the outer sleeve tightly clamping the exposed outer conductor therebetween. According to the present invention, the central contact is provided with a connecting portion to be press-deformed to thereby mechanically and electrically couple with the exposed central conductor, the insulator holder being formed of an insulator into a sleeve body and having radially inwardly projecting inner projections which come in press contact with the central contact and the exposed inner insulator, respectively, the insulator holder and the ferrule being arranged adjacent to one another in an axial direction to have facing axial ends and being engaged one another at the facing axial ends in order to prevent relative rotation thereof, the outer conductive sleeve having a deforming portion for tightly clamping the exposed outer conductor with the ferrule after being press-deformed.

According to an aspect, the central contact is a female contact for mating with a pin contact. The female contact comprises the connecting portion, a first contact portion axially extending from the connecting portion to a first extending end and having a first inner contact surface, a second contact portion extending along the first contact portion from the connecting portion with gradually reduced gap therebetween and having a second extending end short of the first extending end, a ring like member supported at the first extending end defining an opening for receiving the pin contact, and an axial guide portion axially extending from the ring like member along the first contact portion toward but short of the second extending end for guiding the pin contact inserted through the opening into the gap between the first and second contact portions.

According to the present invention, a coaxial multicore receptacle is also obtained which is used together with the thin-type coaxial connector. The receptacle comprises: a substrate made of insulating material and having a main surface; a plurality of ground pins and power source pins set upright on the main surface and arranged in a matrix pattern of rows and columns in the substrate, the matrix pattern having a plurality of unit square areas each defined by adjacent two of the rows and adjacent two of the columns; a plurality of signal pins set upright on the main surface of the substrate, each signal pins being located at about the center of the unit square area, each signal pins being for mating with, as the pin contact, the female contact of the coaxial connector; a guide plate of insulator overlaid on the main surface of the substrate and having a plurality of ground pin guiding holes, a plurality of power source pin guiding holes, and a plurality of signal pin guiding holes through which the ground pins, the power source pins, and the signal pins are inserted, respectively; insulator caps formed integral with opening edges of the power source pin guiding holes and set upright on the guide plate, the power source pins being inserted into and covered with the insulator caps, respectively; a base plate of insulator fixedly mounted on the guide plate with a space left therebetween and having coaxial connector receiving holes in registry with the signal pin guiding holes, respectively, for receiving the coaxial connectors to enable the coaxial connectors to mate with the signal pins, respectively; a plurality of pairs of first and second ground elements of metal mounted on and extending from the base plate toward the ground pin guiding holes and the power source pin guiding holes, respectively, to make contact with the ground pins and to clamp the insulator caps, respectively; and a plurality of pairs of first and second coaxial ground plates of metal mounted on and extending from the base plate between adjacent pairs of the first and second ground elements toward the guide plate to be able to make contact with adjacent ones of the coaxial connectors inserted through the coaxial connector receiving holes.

BRIEF DESCRIPTION OF THE DRAWINGS

FIG. 17 is a perspective view illustrating a substrate, signal pins, ground pins, and power source pins;

FIG. 18 is a plan view corresponding to FIG. 17;

FIG. 19 is a perspective view showing a part of a base plate, ground elements, and coaxial ground plates arranged on a guide plate;

FIG. 20 is a plan view of the ground elements, coaxial ground plates, and the guide plate;

FIG. 21 is a plan view of the guide plate;

FIG. 22 is a sectional view taken along line 22—22 in FIG. 20;

FIG. 23 is a sectional view taken along line 23—23 in FIG. 20;

FIG. 24 is a sectional view taken along line 24—24 in FIG. 20;

FIG. 25 is a sectional view taken along line 25—25 in FIG. 20;

FIG. 26 is a sectional view illustrating a step for inserting an insulator cap between a pair of the ground elements;

FIG. 27 is an exploded perspective view of the base plate and side frames;

FIG. 28 is a perspective view of an assembling step of the guide plate onto an assembly of the base plate and the side plates; and FIG. 29 is a perspective view of an assembled one corresponding to FIG. 28.

DESCRIPTION OF PREFERRED EMBODIMENTS

Prior to description of embodiments of the present invention, a known coaxial connector and coaxial multi-core receptacle will be described below.

Figure 1:
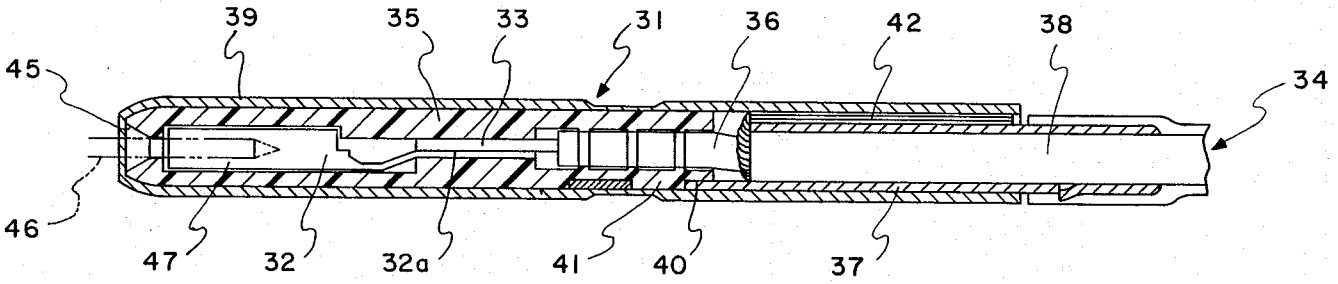
FIG. 1 PRIOR ART
FIG. 1 is a cross sectional view of a known coaxial connector together with a coaxial cable.
Figure 2:
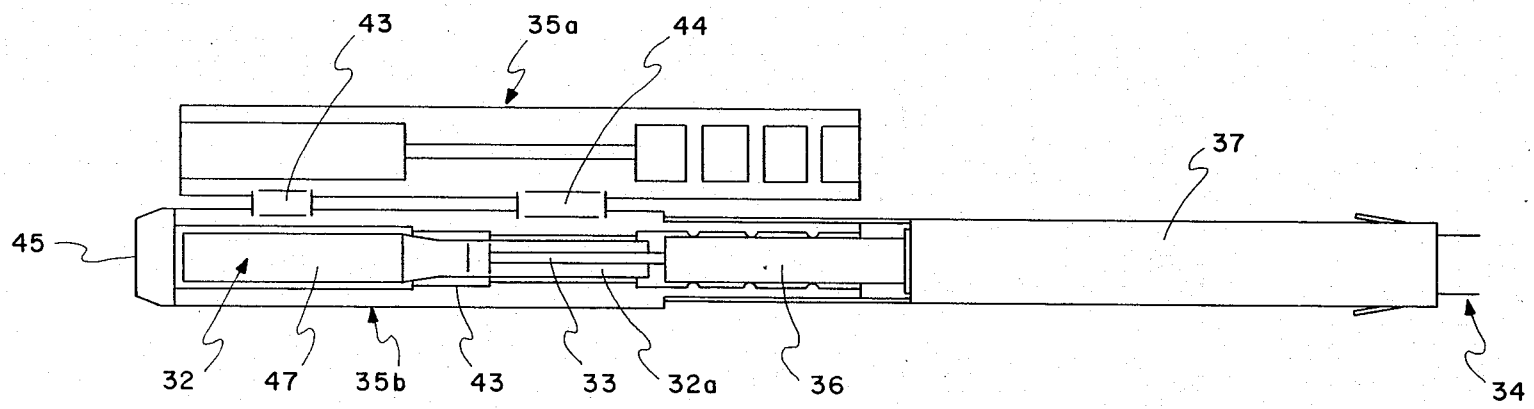
FIG. 2 PRIOR ART
FIG. 2 is a plan view of an assembling step of the coaxial connector of FIG. 1 with a holder of two half-cylinders being open.

Referring to FIGS. 1 and 2, the known coaxial connector 31 comprises a central contact 32 connected to an exposed end of a central conductor 33 of a coaxial cable 34, an insulator holder 35 covering the central contact 32 and an inner insulator sheath layer 36 of the coaxial cable 34, a cylindrical ferrule 37 fitted onto an outer jacket layer 38 of the coaxial cable 34, and a cylindrical outer conductor sleeve 39 closely fitted onto the holder 35 and the ferrule 37. The cylindrical ferrule 37 is axially arranged adjacent with the holder 35. The ferrule 37 has an axial projection 40 of a half-cylindrical shape which is radially superposed with the insulator holder 35. The half-cylindrical projection 40 has an aperture which engages a protrusion 41 radially projecting on an outer surface of the insulator holder 35 to prevent relative rotation of the insulator holder 35 and the ferrule 37. An exposed end portion of an outer conductor or a shield 42 of the coaxial cable 34 is folded back onto an outer surface of the ferrule 37 and is tightly clamped by the outer conductor sleeve 39 and the ferrule 37.

In the known coaxial connector, soldering is used for connecting the central conductor 33 of the coaxial cable 34 and the central contact 32. The central contact 32 has a connecting terminal portion 32*a* which is connected to the central conductor 33 of the coaxial cable 34 by soldering. The holder 35 comprises two half-cylinder parts 35*a* and 35*b* hinged each other by hinge portions 43 and 44, as shown in FIG. 2. After completion of the soldering, the central contact 32, central conductor 33 and the inner sheath layer 36 are contained in a longitudinal groove 43 in one half-cylindrical part 35*b* and the two half-cylinder parts 35*a* and 35*b* are combined to form a cylinder enclosing the central contact 32, central conductor 33 and the inner sheath layer 36 therein.

The structure has the problems which have been described in the preamble.

The coaxial connector is provided with an opening 45 through axial end portions of the outer conductor sleeve 39 and the insulator holder 35 for receiving a pin contact 46.

Figure 3:
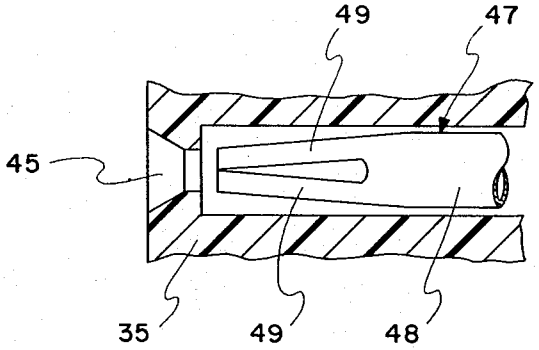
FIG. 3 PRIOR ART
FIG. 3 is an enlarged sectional view of a portion of a contact portion together with the holder in FIG. 1.

Referring to FIG. 3 in addition to FIG. 1 and 2, the central contact 32 has a female contact portion 47 for mating with the pin contact 46. The contact portion 47 comprises a cylindrical supporting portion 48 fixed to the connecting terminal portion 32*a* and a pair of spring contact portions 49 extending from an end of the supporting portions 48 opposite the terminal portion 32*a*. The pair of spring contact portions 49 generally forms a cylinder together but are formed so that their extending ends approach each other.

This central contact structure also has the problem as described in the preamble.

Figure 4:
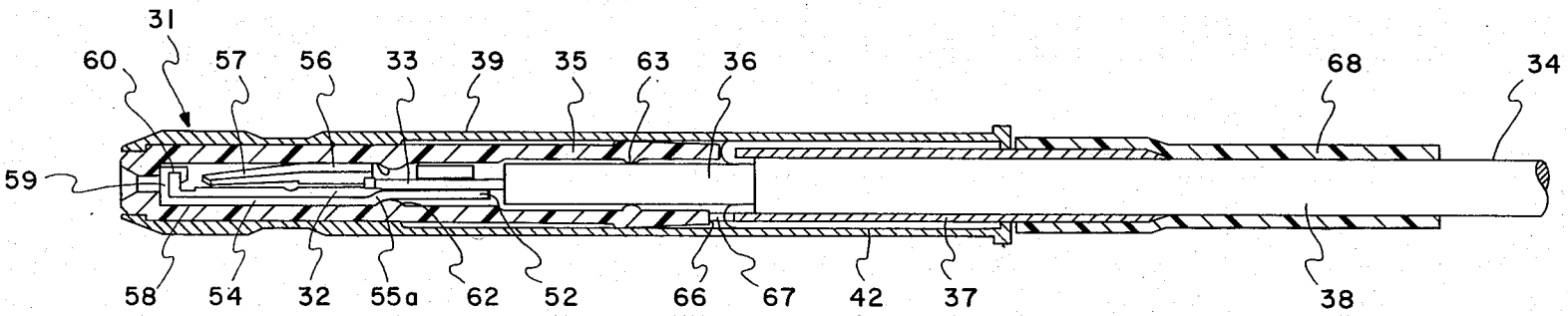
FIG. 4 is a cross sectional view of a coaxial connector according to one embodiment of the present invention.

Referring to FIG. 4, a coaxial connector 31 according to an embodiment of the present invention also is generally similar to the known coaxial connector in that it comprises a central contact 32, an insulator holder 35, a ferrule 37 and an outer conductor sleeve 39. However, the central contact 32, insulator holder 35 and the ferrule 37 have different structures from known ones as described below.

Figure 5:
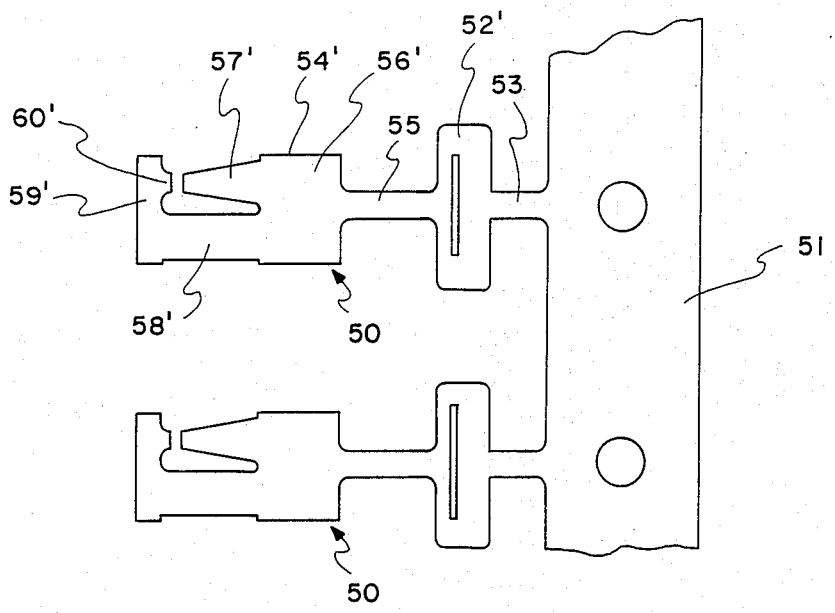
FIG. 5 is a development view illustrating central contact parts used in the coaxial connector of FIG. 4 which are punched from a metal sheet.

The central contact 32 is formed from a sheet of conductive plate. Referring to FIG. 5, a conductive plate is sequentially punched to form a plurality of contact plate parts 50 having a shape shown in the figure and carried by a carrier plate 51. Each of the contact plate parts 50 comprises a connecting plate section 52′ coupled to the carrier plate 51 through a supporting element 53 and a contact plate section 54′ coupled to the connecting plate section 52′ through a coupling section 55. The contact plate section 54′ comprises a comparatively broad supporting plate section 56′ and a pair of contact plate sections 57′ and 58′ extending from the supporting plate section 56′ in a direction opposite the coupling section 55. The contact plate section 57′ has a tapered end and the other contact plate portion 58′ extends longer than the contact plate portion 57′. A lateral plate section 59′ laterally extends from an extending section of the contact plate portion 58′ and has a projection plate portion 60′ projecting therefrom to the tapered end of the contact plate portion 57′. A gap is left between the tapered end of the contact plate portion 57′ and the projection plate portion 60′.

Figure 6:
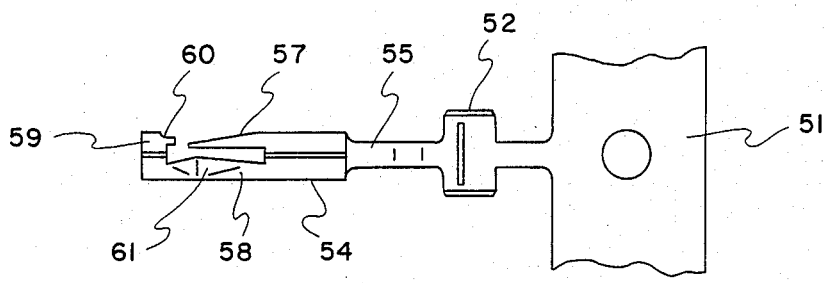
FIG. 6 is a plan view of the central contact obtained by bending the central contact part in FIG. 5.
Figure 7:
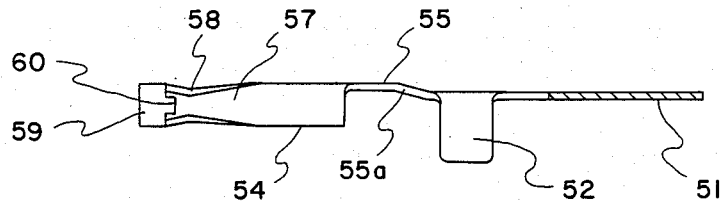
FIG. 7 is a side view of the central contact of FIG. 6.

Then, bending is performed onto the connecting plate portion 52′ and the contact plate part 50 as shown in FIGS. 6 and 7 to form the central contact 32 comprising a connecting portion 52 and a contact portion 54 connected to each other by the coupling section 55. That is, the connecting portion 52 is formed in a U-shape, and the contact portion 54 is formed cylindrical. The coupling section 55 is also formed to have an offset portion 55*a*. These punching and bending processes are sequentially performed by carrying the carrier 51.

Figure 8:
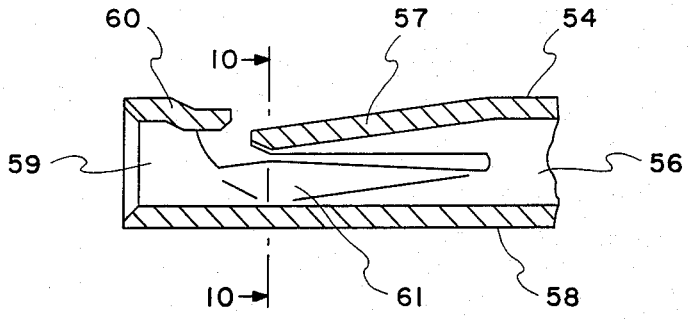
FIG. 8 is a cross sectional view of a contact portion of the central contact of FIG. 6.
Figure 9:
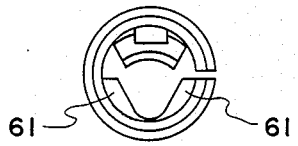
FIG. 9 is a front view of the contact portion of FIG. 8.
Figure 10:
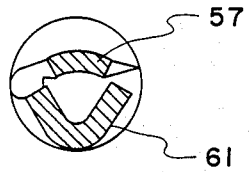
FIG. 10 is a sectional view taken along line 10—10 in FIG. 8.

Referring to FIGS. 8 to 10, the contact portion 54 comprises a cylindrical supporting portion 56 formed by bending the supporting plate portion 56′ in a cylindrical form, a spring contact portion 57 formed from the contact plate portion 57′ and a receiving contact portion 58 formed from the contact plate portion 58′. Therefore, the receiving contact portion 58 extends longer than the spring contact portion 57.

The receiving contact portion 58 has a ring member 59 formed by bending the lateral plate section 59′ in a ring form and an axial guide portion 60 formed by bending the projection 60. Therefore, the guide portion 60 faces the spring contact portion 57 with a gap therebetween and serves as a guide for insertion of a pin contact.

The spring contact portion 57 is formed to approach the receiving contact portion 58 at the tapered end portion. The receiving contact portion 58 is deformed to have a V-shaped section 61 at a position facing the tapered end of the spring contact portion 57, as clearly shown in FIG. 10. The tapered end of the spring contact portion 57 and the V-shaped section 61 come in contact with a pin contact.

Figure 11:
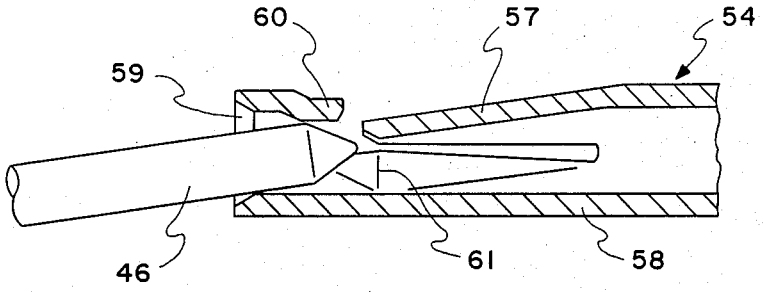
FIG. 11 is a sectional view illustrating a relation of the contact portion of FIG. 8 and a pin contact inserted into the contact portion.

Referring to FIG. 11, when the pin contact 46 is fitted into the contact portion 54 through an opening defined by the ring member 59, its forward end touches the guide portion 60. Then, the pin contact 46 is guided by the guide portion 60 and is completely inserted into the contact portion 54. This means that the pin contact 46 is reliably inserted into the contact portion 54 even if it is inserted through the opening with a slight slant angle from an axis of the contact portion 54 as shown in FIG. 11.

Figure 12:
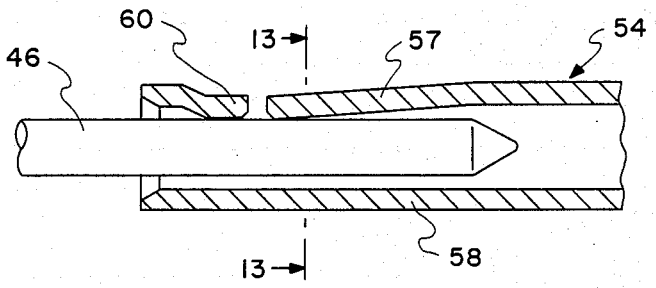
FIG. 12 is a sectional view illustrating an inserted condition of the pin contact into the contact portion.
Figure 13:
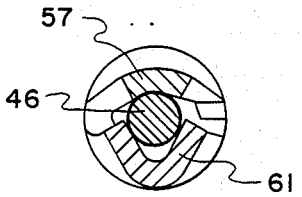
FIG. 13 is a sectional view taken along line 13—13 in FIG. 12.

When the pin contact 46 is completely inserted in a condition shown in FIGS. 12 and 13, it comes into contact with the guide portion 60, the tapered end of the spring contact portion 57 and the V-shaped section 61 of the receiving contact portion 58. Accordingly, the central contact 32 is free from deformation on insertion of the pin contact 46.

Returning to FIG. 4, the central contact 32 is electrically and mechanically connected by press-deforming the connecting portion 52 together with the central conductor 33.

The insulator holder 35 is a discrete sleeve body made of insulator material such as a plastic resin. The holder 35 is provided with first and second thick inner projections 62 and 63 at axially different positions. One of the first inner projections 62 engages with the offset portion 55*a* of the coupling section 55 to prevent axial movement of the central contact 32. The second inner projections 63 are in close contact with the inner sheath layer 36 to thereby be prevented from axial movement relative to the coaxial cable 34.

Figure 14:
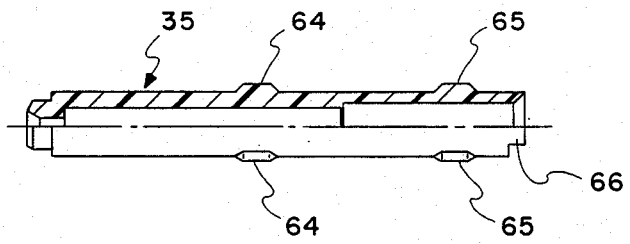
FIG. 14 is a half-sectional view of a insulator holder used in the coaxial connector of FIG. 4.
Figure 15A:
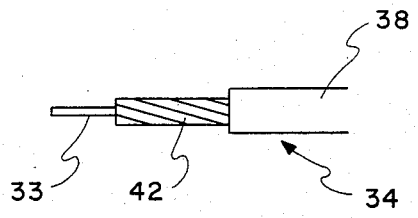
FIG. 15(*a*) to 15(*f*) are views illustrating steps for assembling the coaxial connector of FIG. 4 onto an end of a coaxial cable.
Figure 15B:
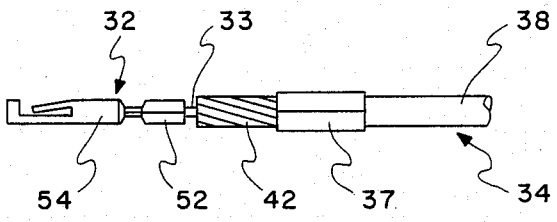
Figure 15C:
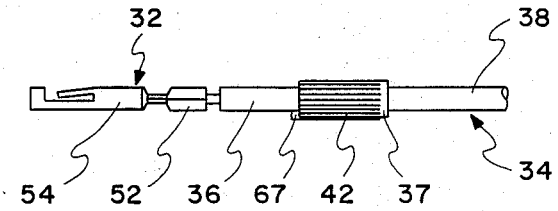
Figure 15D:
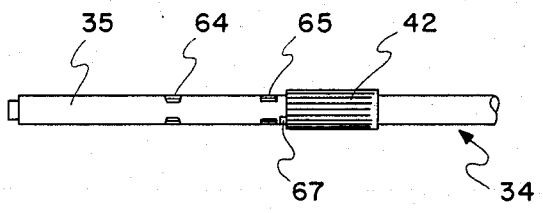
Figure 15E:
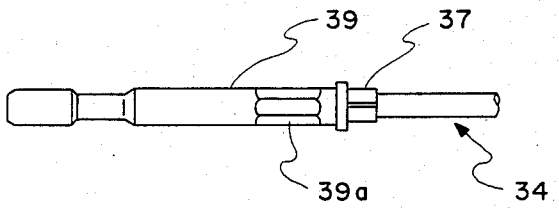
Figure 15F:
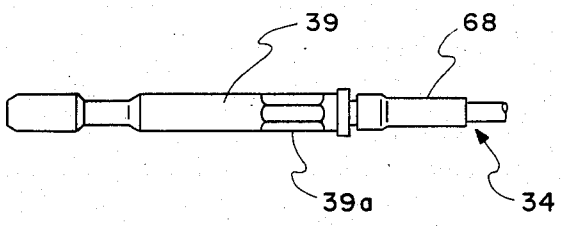

Referring to FIG. 14, the insulator holder 35 is formed in a discrete sleeve body having first and second outer projections 64 and 65 on its outer surface. The first and the second inner projections 62 and 63 are caused by the first and second outer rims 64 and 65, respectively, by fitting the outer conductor sleeve 39 as will later be described. The holder 35 is further provided with a cut-away portion 66 in an axial end.

Referring to FIG. 4 again, the ferrule 37 has an axial protrusion 67 which is fitted into the cut-away portion 66. The fitting of the cut-away portion 66 and the protrusion 67 serves to prevent relative rotation of the holder 35 and the ferrule 37.

The outer conductor sleeve 39 is also fitted onto the insulator holder 35 nd the ferrule 37 with clamping the folded shield 42 between the ferrule 37 and the outer conductor sleeve 39. The outer conductor sleeve 39 is deformed at a portion lying the shield 42 and is mechanically and electrically connected to the shield 42 and the ferrule 37.

Now, referring to FIGS. 15(*a*) to 15(*f*) in addition to FIG. 4, description will be made as to assembling the coaxial connector 31 onto an end of the coaxial cable.

At first, one end of the coaxial cable 34 is worked to expose the central conductor 33 and the shield 42 as shown in FIG. 15(*a*). Then, the central contact 32 is connected by inserting the central conductor 33 into the U-shape connecting portion 52 and press-deforming the connecting portion 52 to form mechanical and electrical connection between the central conductor 33 and the connecting portion 52. While, the ferrule 37 is attached onto the outer jacket 38 of the coaxial cable 34 as shown in FIG. 15(*b*).

Figure 16:
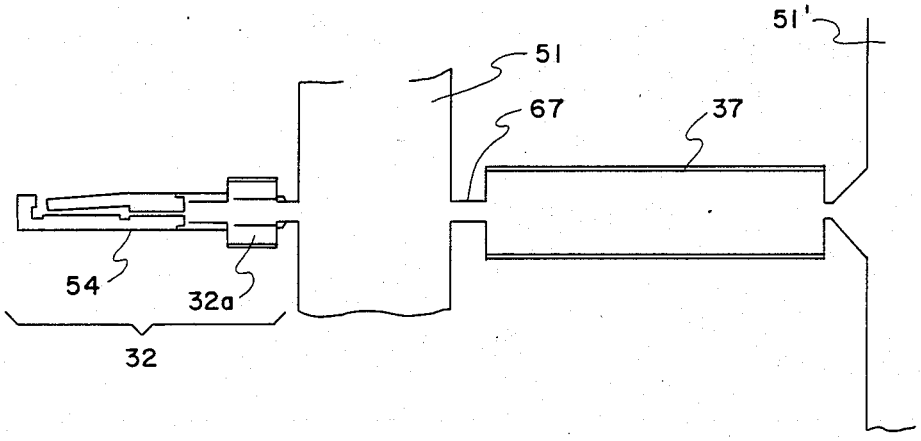
FIG. 16 is a plan view of the central connector part and a ferrule part similar to FIG. 6.

The central contact 32 is formed independently from the ferrule 37 as shown in FIG. 5, but can be made together with the ferrule 37 from a metal sheet, as shown in FIG. 16. In the figure, the central contact 32 and the carrier 51 are similar those in FIGS. 6 and 7. However, the ferrule 37 and its carrier 51' are also formed together with the central contact 32 and the carrier 51. In this case, the central contact 32 and the ferrule 37 are attached to the coaxial cable at the same attaching step. After attaching the central contact 32 and the ferrule 37 to the coaxial cable 34, the carriers 51 and 51' are removed by cutting.

After completion of attaching the central contact 32 and the ferrule 37 to the coaxial cable 34, the shield 42 is folded back and extended along the outer surface of the ferrule 37 as shown in FIG. 15(*c*). In this connection, the shield 42 is regulated to uniformly cover the outer surface of the ferrule 37. Further, it is noted that the shield 42 is drawn out of the protrusion 67 of the ferrule 37. Thus, the inner sheath layer 36 is exposed.

Then, the cylindrical holder 35 is fitted onto the central contact 32 and the inner sheath layer 36 as shown in FIG. 15(*d*) under a condition where the protrusion 67 is fitted into the cut-away portion 66 of the holder 35 as shown in FIG. 4. During the process, the connection of the central conductor 33 and the central contact 32 is not broken by application of an external force caused on fitting of the holder 35, because the connection is made by the press-deformation of the connecting portion 32*a*.

Thereafter, the cylindrical outer conductor sleeve 39 is closely fitted onto the holder 35 and the folded shield 42, as shown in FIG. 15(*e*). When the outer conductor sleeve 39 is fitted onto the holder 35, its inner surface presses the first and second outer projections 64 and 65 inwardly. As a result, the first outer projection 64 forms the first inner projection 62 which projects inwardly and engages the offset portion 55*a*, as clearly shown in FIG. 4. The first inner projection 62 stops axial and radial movement of the central contact 32 to prevent its movement upon insertion of the pin contact 46 into the contact portion 54. The second outer projections 65 form the second inner projections 63 which are in close contact with the inner sheath layer 36 so that the holder 35 is tightly clamped by the outer surface of the inner sheath layer 36 and the inner surface of the outer conductor sleeve 39 to thereby prevent relative movement of the inner sheath layer 36 and the outer conductor sleeve 39, as shown in FIG. 4.

In FIG. 15(*e*), press deformation is outwardly carried out onto the outer conductor sleeve 39 so that the outer conductor 39 has, for example, a hexagonal section 39*a* at a portion which is in contact with the shield 42. As a result, the shield 42 is tightly clamped between the ferrule 37 and the outer conductor sleeve 39.

Finally, an exposed end of the ferrule 37 is covered with a part of a tube 68 as shown in FIG. 15(*f*). Thus, assembling of the coaxial connector is completed as shown in FIG. 4.

In the above-described coaxial connector, since press deformation is used for connection of the central contact 32 and the central conductor 33, the holder 35 can be made as a discrete sleeve without considering occurrence of breakage of the connection upon fitting the holder 35 of a discrete sleeve onto the central contact 32 and the inner sheath layer 36. Therefore, it is possible to reduce the occurrence rate of inferior deformation of the holder 35 and it is easy to attach the holder 35 onto the central contact 32 and the inner sheath layer 37. Further, the first and the second inner projections 62 and 63 of the holder 35 serve to prevent relative movement of the coaxial cable 34, the central contact 32, the holder 35, and the outer conductor sleeve 39. The engagement of the cut-away portion 66 and the protrusion 67 prevents relative rotation of the holder 35 and the ferrule 37. Moreover, the outer conductor sleeve 39 is closely fitted onto the holder 35 and is press-deformed onto the shield 42 and the ferrule 37, so that no relaxation is caused between parts connected to each other.

Referring to FIGS. 17 to 29, a coaxial multicore receptacle according to the present invention is described below which is provided with a plurality of ground pins, a plurality of power source pins, and a plurality of signal pins each of which mates with the coaxial connector described in connection with FIGS. 4 to 16.

Figure 17:
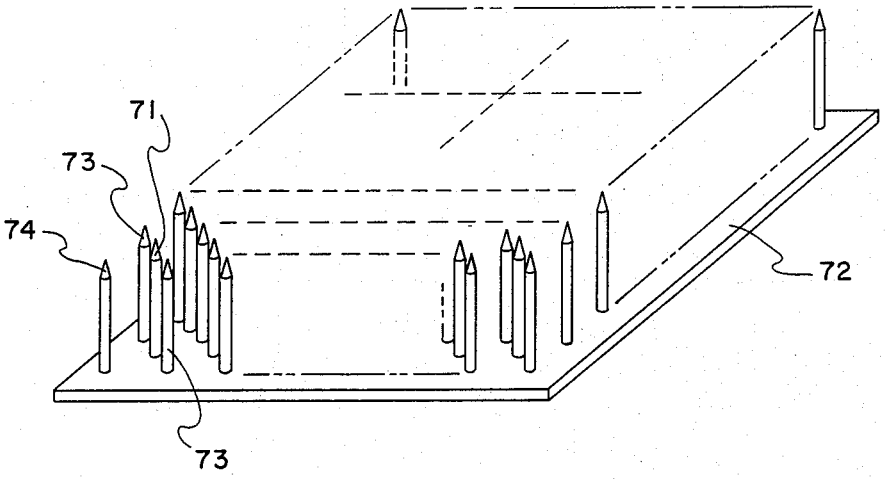
FIGS. 17–29 shows a coaxial multicore receptacle according to an embodiment of the present invention.
Figure 18:
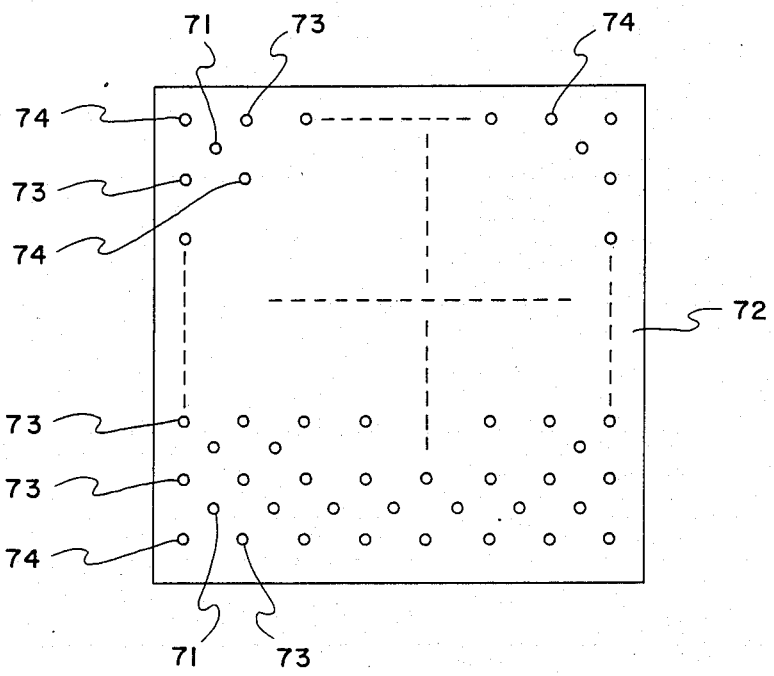

Referring to FIGS. 17 and 18, a plurality of signals pins 71 are set upright at the centres of square areas of a matrix pattern on a main surface of an insulator substrate 72, respectively. A plurality of ground pins 73 and power source pins 74 are also set upright at cross points of the matrix pattern, respectively.

The substrate 72 is usually provided with a signal processing circuit (not shown) having signal input and output lines, ground lines, and power source lines which are connected to the signal pins 71, ground pins 73, and the power source pins 74, respectively. Alternatively, the substrate 72 is also provided with pins and/or sockets on the opposite surface which are connected to the signal pins 71 and also connected to a large scaled integrated circuit elements (LSIs).

Figure 22:
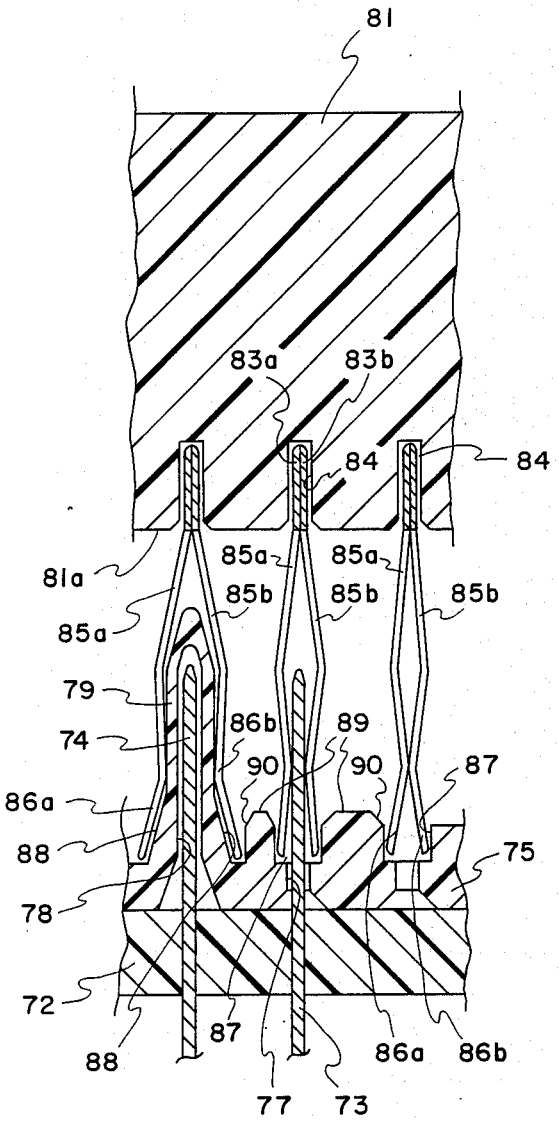
Figure 23:
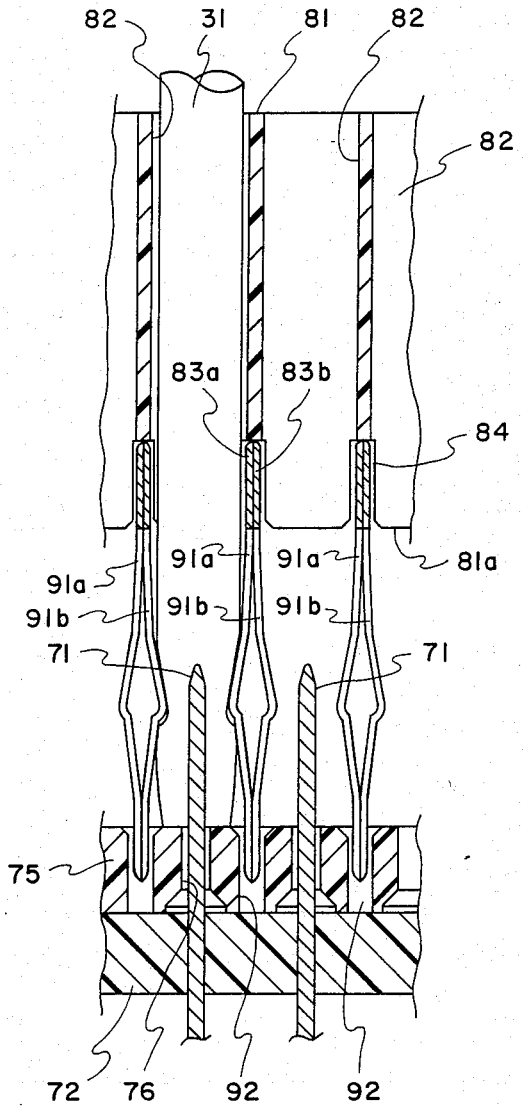
Figure 24:
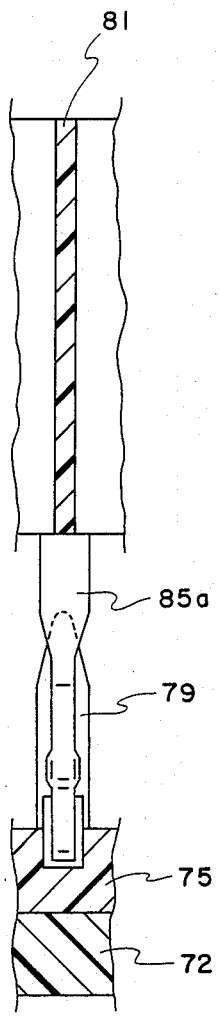

Referring to FIGS. 19 to 26, a guide plate 75 of an insulator is laid onto the substrate 72. The guide plate 75 is formed with signal pin guiding holes 76, ground pin guiding holes 77, and power source pin guiding holes 78. The signal pins 71, the ground pins 73 and the power source pins 74 are inserted through the signal pin guiding holes 76, the ground pin guiding holes 77 and the power source pin guiding holes 78, respectively, as shown in FIGS. 22 and 23.

Figure 19:
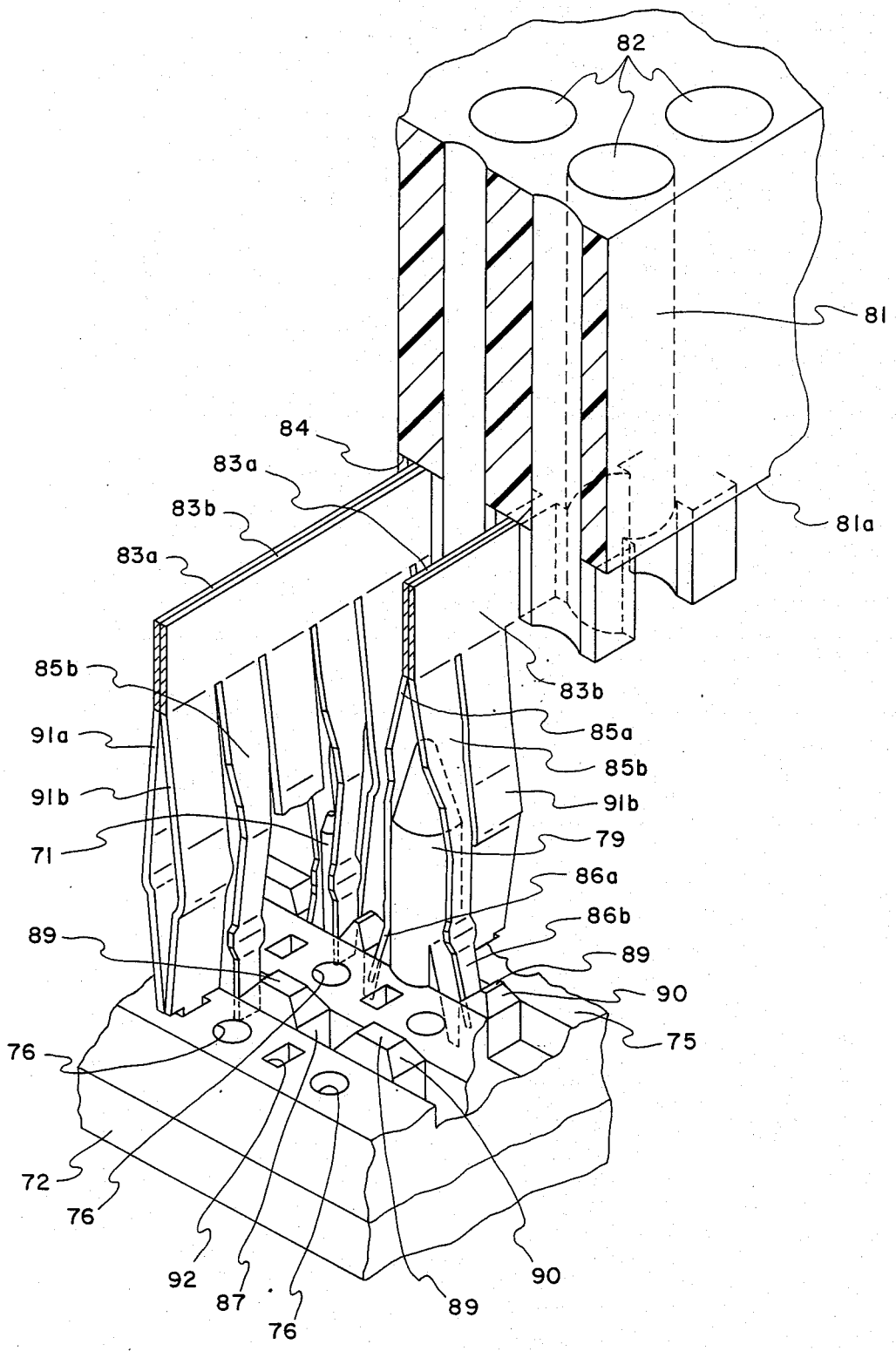

An insulator cap 79 is formed integral with an opening edge of each power source pin guiding holes 78 and is set upright on the guide plate 72, as shown in FIGS. 19 and 22. The insulator cap 79 is formed with a tapered top end. Each power source pin 74 is inserted into and covered with the insulator cap 79. Therefore, the ground pin guiding holes 77 and the power source pin guiding holes 78 are arranged in rows and columns of a matrix pattern which is similar to the matrix pattern of the ground pins 73 and the power source pins 74. The signal pin guiding holes 76 are also disposed at the centers of square areas of the matrix pattern, respectively.

Referring to FIGS. 19, 22, and 23, a base plate 81 of an insulator is disposed opposite to the guide plate 75 with a space left therebetween. The base plate 81 is formed with coaxial connector receiving holes 82 in registry with the signal pin guiding holes 76, as shown in FIGS. 19 and 23. The coaxial connector 31 is inserted into each of the coaxial connector receiving holes 31 and mates with each of the signal pins 71.

Figure 20:
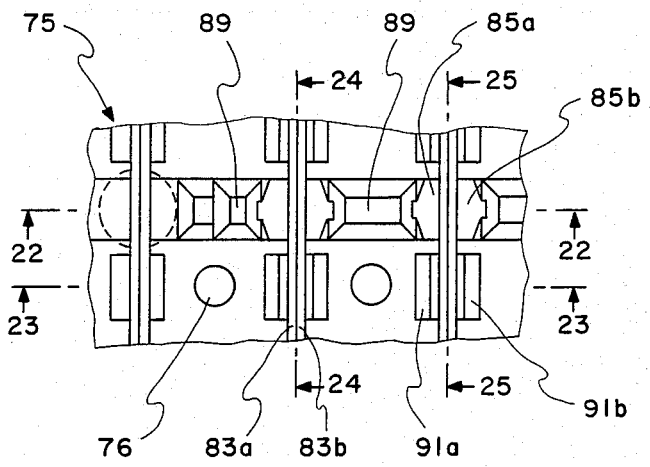
Figure 21:
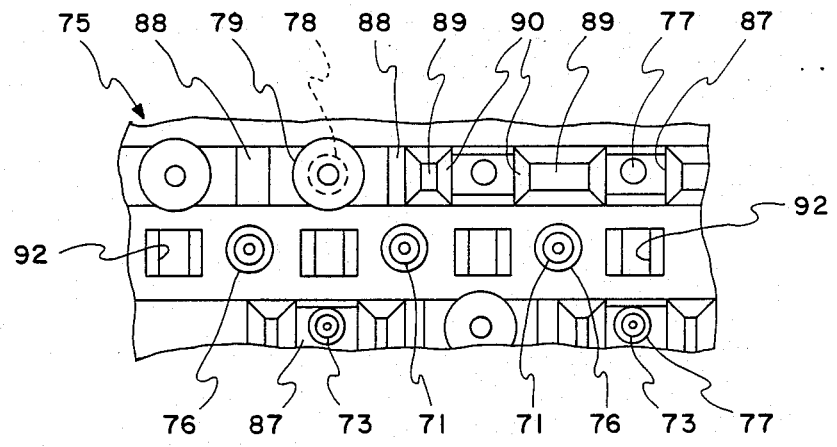
Figure 25:
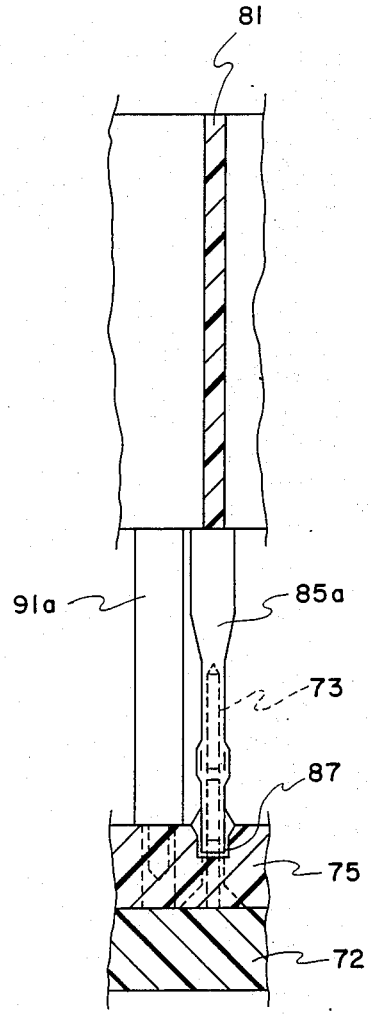

Referring to FIGS. 19, 20, and 22, the base plate 81 is provided with a plurality of pairs of metal strips 83*a* and 83*b* at a main surface 81*a* facing the guide plate 75. That is, the base plate 81 is formed with grooves 84 in the main surface 81*a* in registry with rows of the ground pin guiding holes 77 and the power source pin guiding holes 78 arranged in the matrix pattern. The paired metal strips 83*a* and 83*b* are superposed and are fitted together into each of the grooves 84. Therefore, the paired metal plates 83*a* and 83*b* extend over and along each row of the ground pin guiding holes 77 and the power source pin guiding holes 78. Each of the metal strips 83*a* and 83*b* is provided with a plurality of ground elements 85*a* and 85*b* which extend from different positions of each metal strip of 83*a* and 83*b* toward each opposite row of the ground pin guiding holes 77 and the power source pin guiding holes 78 in the guide plate 75. Each one of the ground elements 85*a* of one metal strip 83*a* is paired with adjacent one of the ground elements 85*b* of the other metal plate 83*b* paired with the one metal strip 83*a*. Accordingly, a pair of metal strips 83*a* and 83*b* has a plurality of pairs of ground elements 85*a* and 85*b*. The paired ground elements 85*a* and 85*b* elastically clamp each of the ground pins 73 and the insulator caps 79, as shown in FIGS. 19, 22, and 25.

The paired ground elements 85*a* and 85*b* have introducing portions 86*a* and 86*b* at their extending end portions. The introducing portions 86*a* and 86*b* are apart from each other adjacent the guide plate 75 so as to enable each of the ground pins 73 and the insulator caps 79 to be readily introduced between the paired ground elements 85*a* and 85*b* when the base plate 81 is assembled to the substrate 72 and the guide plate 75. Thus, some of pairs of ground elements 85*a* and 85*b* clamp ground pins 73 therebetween, respectively, as shown in FIGS. 19,22, and 25 and the extending ends thereof are (that is the introducing ends 86*a* and 86*b*) are inserted into rectangular holes 87 formed in the guide plate 75. Each of the rectangular holes 87 is connected to each of the ground pin guiding holes 77 and is formed as an enlarged opening portion of the corresponding ground pin guiding hole 77.

The other pairs of ground elements 85*a* and 85*b* clamp insulator caps 79 as shown in FIGS. 19, 22, 24, and 26 and their extending ends are received in grooves 88 formed in the guide plate 75 at both sides of each insulator cap 79.

The guide plate 75 is formed with projecting portions 89 having slant side surfaces 90 between adjacent rectangular holes 87 and between each groove 88 and one rectangular hole 87 adjacent the groove 88, so that the extending ends of the ground elements 85*a* and 85*b* can readily be inserted into the rectangular holes 87 and the grooves 88 when the base plate 81 is assembled with the guide plate 75.

The paired metal strips 83*a* and 83*b* are further provided with a plurality of coaxial ground plates 91*a* and 91*b*, respectively, to form a plurality of coaxial ground plates 91*a* and 91*b*, which are disposed between adjacent pairs of ground elements 85*a* and 85*b* along the metal strips. The paired coaxial ground plates 91*a* and 91*b* have intermediate portions which are bent outwardly to be apart from each other. Extending ends of the paired coaxial ground plates 91*a* and 91*b* are commonly inserted in an engaging hole 92 adjacent each signal pin guiding hole 76 in the guide plate 75 and are in contact with each other. Each pair of the coaxial ground plates 91*a* and 91*b* comes in contact with the outer conductor sleeves (39 in FIG. 4) of those coaxial connectors 31 at opposite sides of the pair of coaxial ground plates 91*a* and 91*b* which are inserted in the coaxial connector receiving holes 82.

The ground elements 85*a*, the coaxial ground plates 91*a* and the metal strip 83*a* are formed as a integral body by punching a sheet of metal plate. Similarly, the ground elements 85*b*, the coaxial ground plates 91*b* and the metal strip 83*b* are also formed as an integral body.

Now, referring to FIGS. 27 to 29, assembling of the receptacle is described below.

Figure 26:
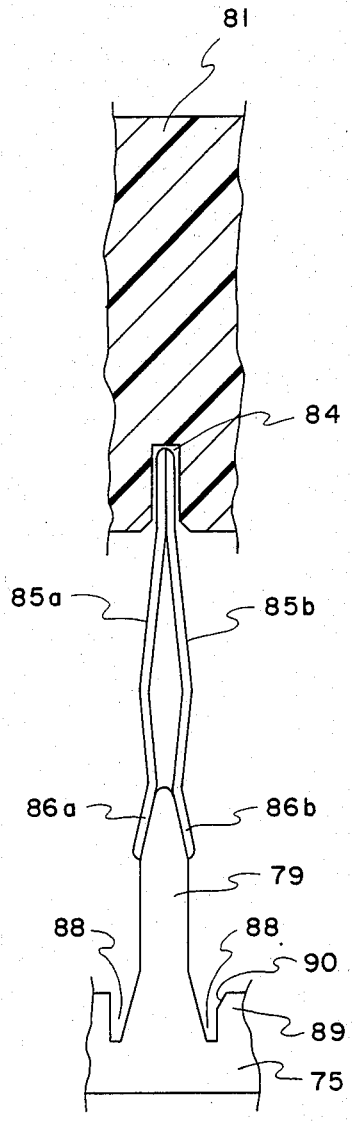
Figure 27:
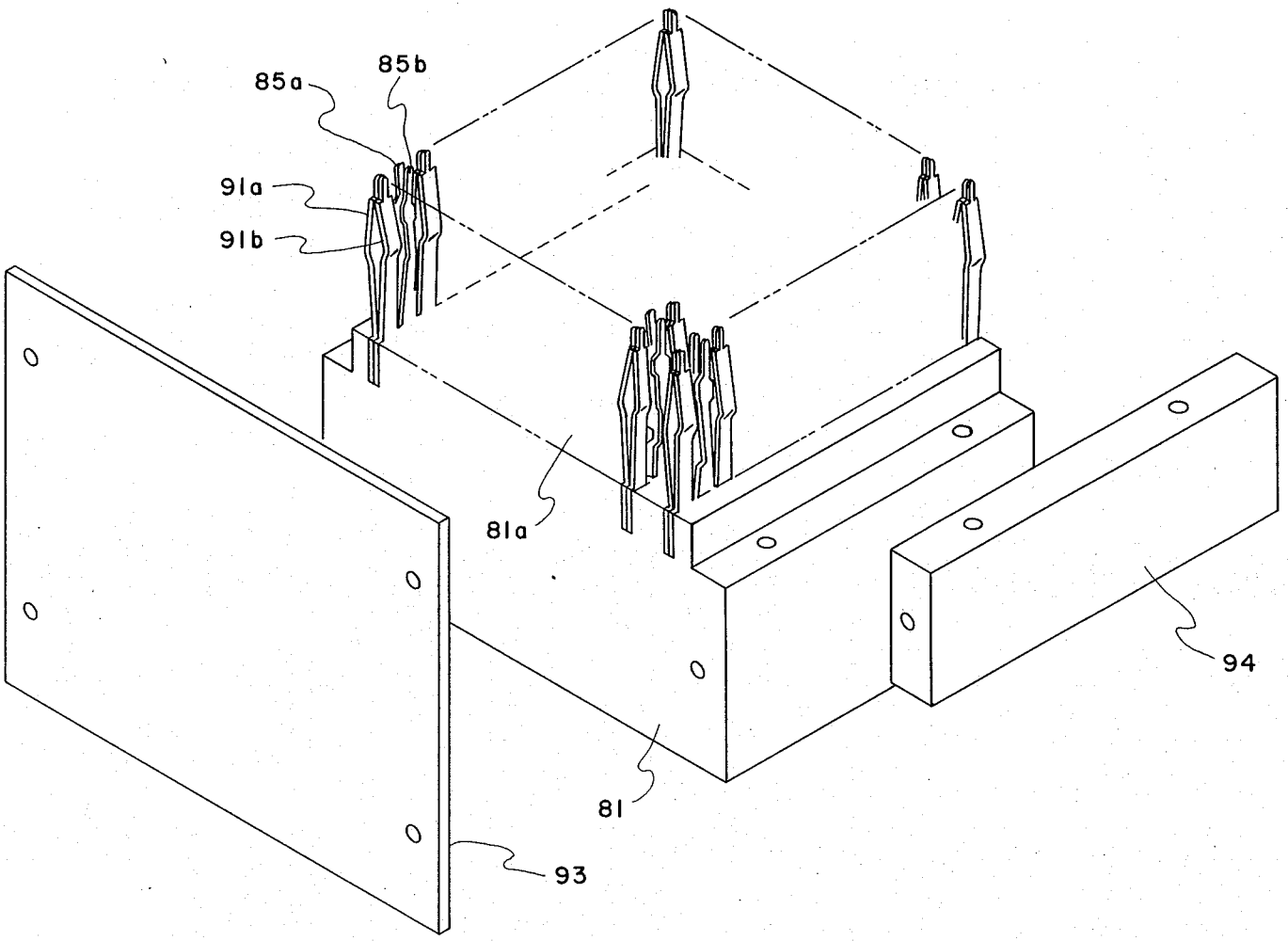
Figure 28:
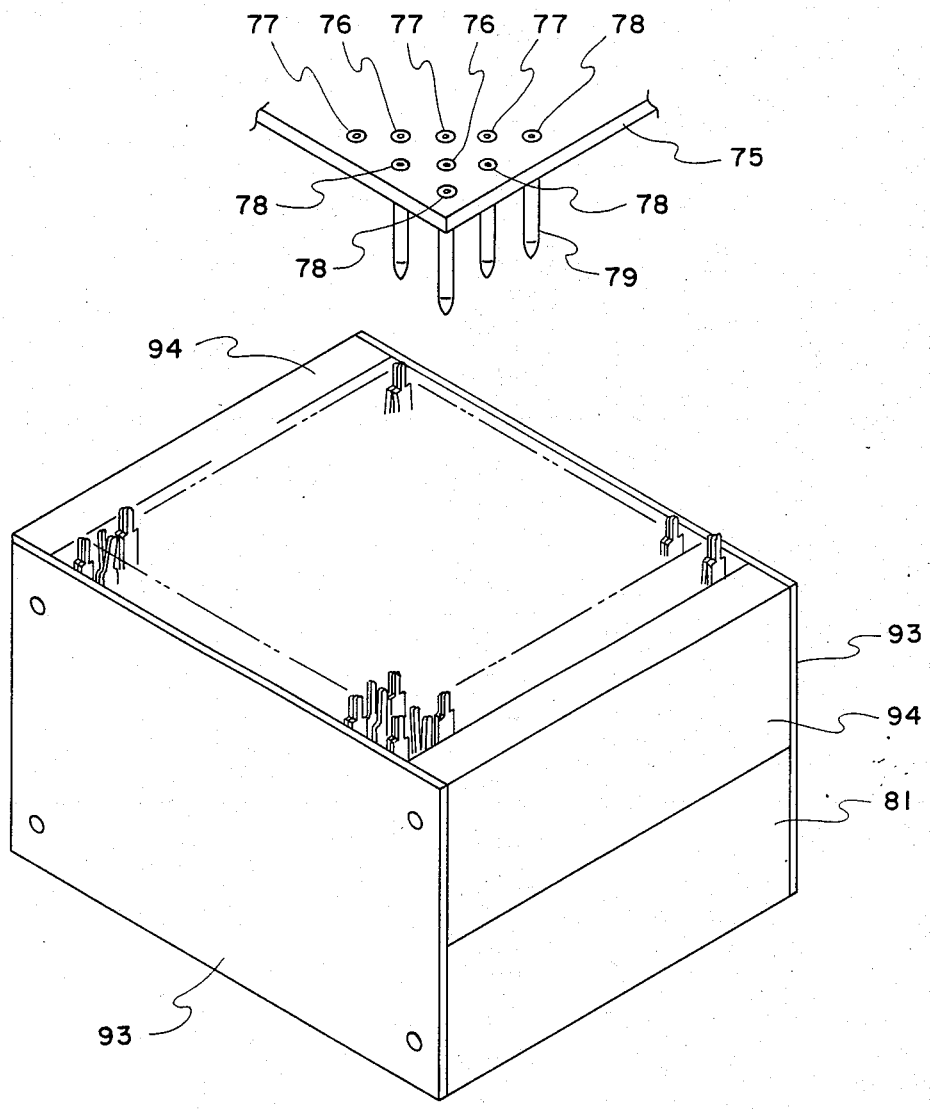
Figure 29:
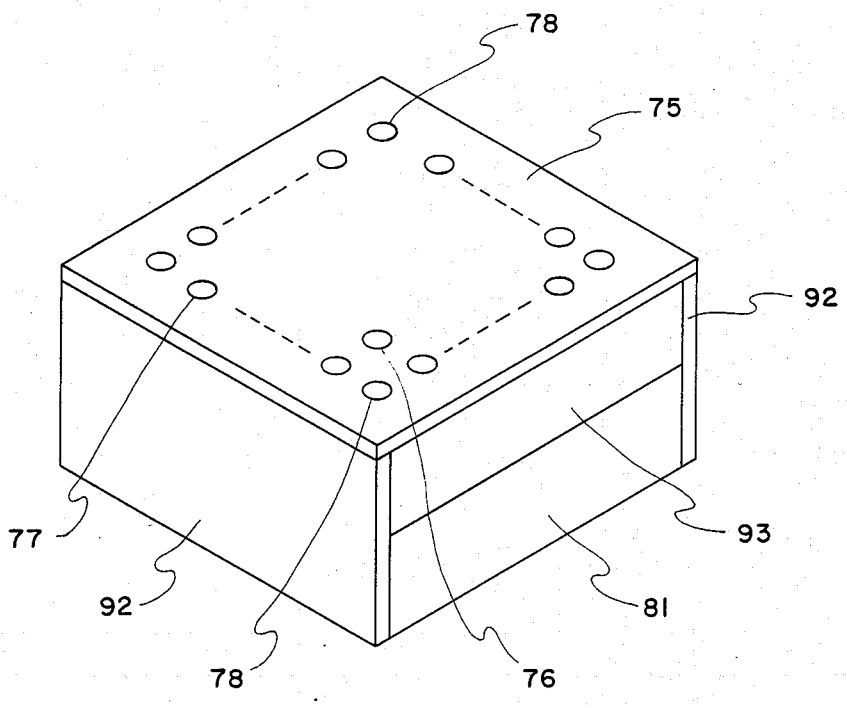

Referring to FIGS. 27 and 28, first two side frames 93 and second two side frames 94 are attached to first opposite sides and second opposite sides of the base plate 81, respectively, to form a space on the main surface 81*a* of the base plate 81 in which the ground elements 85*a* and 85*b* and coaxial ground plates 91*a* and 91*b* are disposed. Then, the guide plate 75 is attached onto the first and second side frames 93 and 94 to close the space as shown in FIG. 29. In that case, the insulator cap 79 is reliably inserted between the ground elements 85*a* and 85*b* because the insulator cap 79 has the tapered end as shown in FIG. 26 and because the ground elements 85*a* and 85*b* have the introducing portions 86*a* and 86*b*. Thus, an assembly is obtained which comprises the base plate 81, first and second side frames 92 and 93, and guide plate 75 as shown in FIG. 29.

Thereafter, the substrate 72 is mounted on the guide plate 75 with signal pins 71, ground pins 73, and power source pins 74 being inserted into the signal pin guiding holes 76, ground pins guiding holes 77, and power source pin guiding holes 78, respectively, as shown in FIGS. 22 and 23.

In the arrangement of the coaxial multicore receptacle as described above, when coaxial connectors 31 are inserted into the coaxial connector receiving holes 82 as shown in FIG. 23, their central contacts (32 in FIG. 4) are connected to signal pins 71 and their outer conductor sleeves (39 in FIG. 4) come in elastic contact with the coaxial ground plates 91*a* and 91*b*. While, the coaxial ground plates 91*a* and 91*b* are connected to ground elements 85*a* and 85*b* through metal strips 83*a* and 83*b* which serve as grounding conductors, so that shield is made between signal pins 71 and between the coaxial connectors 31 to thereby prevent cross-talk and make good operation for high speed signals.

Since the insulator caps 79 are formed integral with the guide plate 75, normal receptacles can be assembled without fault under a correct design even if positional relationship is complex between the ground pins 73 and the power source pins 74.

What is claimed is:

1. A thin-type coaxial connector for use in an electrical and mechanical connection of an end of a coaxial cable which comprises a central conductor insulated from an outer conductor by an inner insulator, and an outer insulator jacket; said outer jacket and said inner insulator being cut away at said cable end to expose said central conductor, said inner insulator and said outer conductor as an exposed central conductor, an exposed inner insulator, and an exposed outer conductor, respectively; said coaxial connector comprising a central female contact for making electrical and mechanical connections to said exposed central conductor, an insulator holder for holding said central female contact together with said exposed inner insulator; a ferrule for mounting on said outer jacket; said insulator holder and said ferrule being arranged adjacent to one another in an axial direction to have facing axial ends and being engaged with one another at the facing axial ends in order to prevent a relative rotation thereof; and an outer conductor sleeve fitted onto said insulator holder and said ferrule, said ferrule and said outer sleeve tightly clamping said exposed outer conductor therebetween, wherein:

said central female contact comprising a connecting portion shaped to be press-deformed to mechanically and electrically couple with said exposed central conductor and a contact portion connected to each other by a coupling portion, said contact portion comprising a cylindrical supporting portion connected said coupling portion; a receiving contact portion axially extending from said cylindrical supporting portion to a first extending end, said receiving contact portion having a generally arcuate lateral section and a V-shaped section at a position which is short of said first extending end, said V-shaped section providing an inner contact surface, a spring contact portion extending along said receiving contact portion from said cylindrical supporting portion with a gradually reducing gap therebetween and having a second extending end short of said first extending end, a ring-like member supported at said first extending end and defining an opening for receiving a pin contact, and an axial guide portion axially extending from said ring-like member along said receiving contact portion toward but short of said second extending end for guiding said pin contact inserted through said opening into said gap between said receiving and spring contact portions;

said insulator holder being formed in a discrete sleeve body and having radially inwardly projecting inner projections which come into a press contact with said central female contact and said exposed inner insulator, respectively;

said outer conductive sleeve having a deforming portion for tightly clamping said exposed outer conductor with said ferrule after being press-deformed.

2. A coaxial multicore receptacle for mating with a plurality of thin-type coaxial connectors each for use in making electrical and mechanical connections at an end of a coaxial cable, the coaxial cable comprising a central conductor insulated from an outer conductor by an inner insulator, and an outer insulator jacket; said outer jacket and said inner insulator being cut away at said cable end to expose said central conductor, said inner insulator and said outer conductor as an exposed central conductor, an exposed inner insulator, and an exposed outer conductor, respectively; each of said coaxial connectors comprising a central female contact for making electrical and mechanical connections to said exposed central conductor; an insulator holder for holding said female central contact together with said exposed inner insulator; a ferrule for mounting on said outer jacket; and an outer conductor sleeve fitted onto said insulator holder and said ferrule, said ferrule and said outer sleeve tightly clamping said exposed outer conductor therebetween, said coaxial multicore receptacle comprising:

a substrate made of insulating material and having a main surface;

a plurality of ground pins and power source pins set upright on the main surface and arranged in a matrix pattern of rows and columns in said substrate, said matrix pattern having a plurality of unit square areas each defined by an adjacent two of said rows and an adjacent two of said columns;

a plurality of signal pins set upright on the main surface of said substrate, each signal pins being located at about the center of said unit square area, each signal pins mating, as the pin contact, with the female contact of said coaxial connector;

an insulator guide plate overlaid on the main surface of said substrate and having a plurality of ground pin guiding holes, a plurality of power source pin guiding holes, and a plurality of signal pin guiding holes through which said ground pins, said power source pins, and said signal pins are respectively inserted;

insulator caps formed integral with opening edges of said power source pin guiding holes and set upright on said guide plate, said power source pins being inserted into and covered with said insulator caps, respectively;

an insulator base plate fixedly mounted on said guide plate with a space left therebetween and having coaxial connector receiving holes in registry with said signal pin guiding holes, respectively, for receiving said coaxial connectors to enable said coaxial connectors to mate with said signal pins, respectively;

a plurality of pairs of first and second ground elements of metal mounted on and extending from said base plate toward said ground pin guiding from said base plate toward said ground pin guiding holes and said power source pin guiding holes, respectively, to make contact with said ground pins and to clamp said insulator caps, respectively; and a plurality of pairs of first and second coaxial ground plates of metal mounted on and extending from said base plate between adjacent pairs of said first and second ground elements toward said guide plate to be able to make contact with adjacent ones of said coaxial connectors inserted through said coaxial connector receiving holes.

3. A coaxial multicore receptacle as claimed in claim 2, wherein said first and second ground elements have extending ends adjacent said guide plate, respectively, said guide plate being further formed with a pair of grooves in a surface thereof at both sides of each of said insulator caps for receiving said extending ends of each pair of said first and second ground elements corresponding to each insulator cap, respectively.

4. A coaxial multicore receptacle as claimed in claim 2, wherein said first and second ground elements have extending ends adjacent said guide plate, respectively, said guide plate being provided with an enlarged hole at an opening edge of each of said ground pin guiding holes in a surface thereof for commonly receiving said extending ends of each pair of said first and second ground elements corresponding to each ground pin.

5. A coaxial multicore receptacle as claimed in claim 2, wherein said first and second coaxial ground plates have extending ends adjacent said guide plate, respectively, said guide plate being provided with an engaging hole in a surface thereof adjacent each signal pin guiding hole for commonly receiving said extending ends of each pair of first and second coaxial ground elements corresponding to each signal pin.

* * * * *